US006962620B2

(12) United States Patent
Chang et al.

(10) Patent No.: US 6,962,620 B2
(45) Date of Patent: Nov. 8, 2005

(54) ADJUSTABLE EDDY ELECTROSTATIC PRECIPITATOR

(75) Inventors: Kai-Cheng Chang, Taipei (TW); Pei-Fang Liang, Hsinchu Hsien (TW); Chia-Yuan Chang, Hsinchu (TW); Pin-Cha Hsu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 113 days.

(21) Appl. No.: 10/693,737

(22) Filed: Oct. 27, 2003

(65) Prior Publication Data

US 2005/0000361 A1 Jan. 6, 2005

(30) Foreign Application Priority Data

Jul. 2, 2003 (TW) ..... 92118124 A

(51) Int. Cl.[7] ..... B03C 3/36

(52) U.S. Cl. ..... 96/60; 96/61; 96/63; 96/95; 96/97; 96/98

(58) Field of Search ..... 96/60–63, 95–97, 96/98; 55/DIG. 38

(56) References Cited

U.S. PATENT DOCUMENTS

| | | | | | |
|---|---|---|---|---|---|
| 1,381,719 | A | * | 6/1921 | McGee et al. | 95/69 |
| 2,594,805 | A | * | 4/1952 | Rommel | 96/61 |
| 2,748,888 | A | * | 6/1956 | Hodson | 96/61 |
| 3,526,081 | A | * | 9/1970 | Kusters | 96/61 |
| 4,010,011 | A | * | 3/1977 | Reif | 96/61 |
| 4,202,674 | A | * | 5/1980 | Rodenberger et al. | 96/63 |
| 4,251,234 | A | * | 2/1981 | Chang | 95/78 |
| 4,344,776 | A | * | 8/1982 | Yavnieli | 96/63 |
| 4,352,681 | A | * | 10/1982 | Dietz | 96/61 |
| 4,366,525 | A | * | 12/1982 | Baumgartner | 361/231 |
| 4,390,426 | A | * | 6/1983 | Vicard | 210/243 |
| 4,588,423 | A | * | 5/1986 | Gillingham et al. | 96/43 |
| 4,649,703 | A | * | 3/1987 | Dettling et al. | 60/275 |
| 4,689,951 | A | * | 9/1987 | Polach | 60/275 |
| 4,976,749 | A | * | 12/1990 | Adamski et al. | 95/63 |
| 5,591,253 | A | * | 1/1997 | Altman et al. | 96/61 |
| 5,616,172 | A | * | 4/1997 | Tuckerman et al. | 96/16 |
| 5,667,565 | A | * | 9/1997 | Gondar | 96/60 |
| 5,904,755 | A | * | 5/1999 | Kanazashi et al. | 96/55 |
| 6,090,189 | A | * | 7/2000 | Wikstrom et al. | 96/69 |
| 6,183,200 | B1 | * | 2/2001 | Chang | 416/146 R |
| 6,228,148 | B1 | * | 5/2001 | Aaltonen et al. | 95/74 |
| 6,235,090 | B1 | * | 5/2001 | Bernstein et al. | 96/57 |
| 6,267,802 | B1 | * | 7/2001 | Baldrey et al. | 95/58 |
| 6,398,852 | B1 | * | 6/2002 | Loreth | 96/63 |
| 2002/0017194 | A1 | * | 2/2002 | Stivers | 96/61 |
| 2002/0029690 | A1 | * | 3/2002 | Ridgeway et al. | 95/69 |
| 2005/0000361 | A1 | * | 1/2005 | Chang et al. | 96/61 |

FOREIGN PATENT DOCUMENTS

| | | | | |
|---|---|---|---|---|
| JP | 5-154328 | * | 6/1993 | 96/61 |
| JP | 2002-92014 | * | 3/2002 | |

* cited by examiner

*Primary Examiner*—Richard L. Chiesa
(74) *Attorney, Agent, or Firm*—Finnegan, Henderson, Farabow, Garrett & Dunner, L.L.P.

(57) ABSTRACT

An adjustable eddy electrostatic precipitator, including a main body, an electrode array, an adjustable opening and a precipitating device. The main body has an inner space with an air guiding plate of helical shape, an entrance for air and an exit for air. The electrode array is placed close to the entrance, ionizing air as well as particles floating therein. The adjustable opening is located at the exit, having an adjustable aperture. The precipitating device is connected with a bias high voltage for adsorbing ionized particles. Air entering the main body through the entrance is ionized, ionizing particles floating therein. Ionized particles are driven towards a single zone and are collected depending on size and charge in an adjustable manner.

19 Claims, 6 Drawing Sheets

ADJUSTABLE EDDY ELECTROSTATIC PRECIPITATOR

BACKGROUND OF THE INVENTION

1. Field of the Invention

The present invention relates to an adjustable eddy electrostatic precipitator, particularly to an adjustable eddy electrostatic precipitator which collects ionized particles in a single zone according to sizes and charges thereof in an adjustable manner.

2. Description of Related Art

Conventional precipitators are not able effectively to collect dust particles that have been concentrated, causing high cost due to wear and maintenance. Collecting floating dust particles in regular dust bags is highly desirable. Furthermore, for analysis of air, collecting samples of suspended particles is valuable.

Particles floating in air and exposed to an electrostatic field collide with ions, ionize and are readily driven to a capturing surface, where escaping of the particles is prevented.

In the publications JP2002-92014, US2002/0017194A1, US2002/0029690A1, U.S. Pat. No. 6,090,189 and U.S. Pat. No. 6,267,802, electrostatic precipitators are disclosed for usage in large shop floors.

Specifically, U.S. Pat. No. 6,090,189 discloses an electrostatic filter and supply air terminal having a first electrode, a second electrode and a coil. The first electrode is grounded, and the second electrode is connected to a positive potential. Upon entering the coil, air is ionized, and adsorbed by the positively charged second electrode, so that the air is cleaned of dust particles.

U.S. publication no. 2002/0029690A1 discloses an electrostatic precipitator furnished with a capturing grid. Passing ionized particles are adsorbed by the capturing grid. Knocking against the capturing grid causes vibrations, so that collected dust particles fall into a collecting receptacle placed below.

The devices taught in the remaining publications mentioned above work by the same principle or similar principles for collecting dust particles. However, the devices of these publications are suitable only for environments with a relatively large number of relatively large dust particles in the air. In environments with less dust particles, e.g., apartments, offices or clean production sites, these devices are not effective for further removing of dust particles. In a residential environment, particles suspended in the air typically have sizes of between 1 $\mu$m and 10 $\mu$m and move with air flows.

An air cleaning apparatus used in residential areas accomplishes ionization of air by a single metal tip. An electrostatic plate, located downstream in the air flow, adsorbs charged particles. Thus usual requirements in residential environments are met, but collecting of particles according to various kinds is not possible.

SUMMARY OF THE INVENTION

The object of the present invention is to provide an adjustable eddy electrostatic precipitator, collecting charged dust particles in a single space, for this object comprising a main body with a helical air guiding plate in an inner space thereof, leading air from an entrance with an ionizing electrode array under a whirling movement to an exit, where particles are collected.

Another object of the present invention is to provide an adjustable eddy electrostatic precipitator, collecting charged dust particles according to sizes and charges thereof, for this object having an adjustable opening at the exit and a precipitating device to which a bias high voltage is applied.

A further object of the present invention is to provide an adjustable eddy electrostatic precipitator, allowing to control collecting effectiveness and collected size and charge distribution, for this object having a fan at the entrance or the exit for regulating flow rate and speed of air.

The present invention can be more fully understood by reference to the following description and accompanying drawings.

DETAILED DESCRIPTION OF THE PREFERRED EMBODIMENTS

As shown in FIGS. 1–5, the adjustable eddy electrostatic precipitator of the present invention mainly comprises: a main body 10; an electrode array 20; an adjustable opening 30; a precipitating device 40; and a fan 50.

The main body 10 has an upper end, a lower end, a vertical central axis and an inner space that is of an inverted obtuse cone shape with a comparatively wide entrance 12 on the upper end of the main body 10 and a comparatively narrow exit 13 on the lower end of the main body 10. An air guiding plate 11 of helical shape is laid in the inner space of the main body 10, being attached to an inner periphery thereof.

The electrode array 20 is placed close to the entrance 12, causing air flowing by to be ionized. The electrode array 20 is formed by single conical electrodes 21 or by racks 22 with zigzagging upper surfaces.

The adjustable opening 30 covers the exit 13 from below and consists of a plurality of circular plates 31, each of the circular plates 31 carrying a fixed bolt 311 and a movable bolt 312. For each of the circular plates 31, the fixed bolt 311 is located at the main body 10 at the lower end thereof in a fixed position, and the movable bolt 312 revolves around the fixed bolt 311. Thereby an aperture 313 of the adjustable opening 30 is controlled, like in an iris diaphragm. In another embodiment of the present invention, the adjustable opening 30 has two opaque plates 32 linearly gliding between two parallel rails 33, thus controlling a slit aperture 34 of the adjustable opening 30. The aperture 313, 34 of the adjustable opening 30 allows transmission of ionized particles according to distances thereof to the central axis, thus sorting ionized particles into different kinds.

The precipitating device 40 is connected to a bias high voltage and has a cap 41 for adsorbing ionized particles. The precipitating device 40 is mounted below the adjustable opening 30, with a gap of adjustable width placed in between, allowing to optimize collecting of particles.

The fan 50 is mounted on the entrance 12 or on the exit 13, controlling flow rate and speed of air passing through. Air entering the inner space of the main body 10 through the entrance 12 and passing the electrode array 20, due to the inverted conical shape of the inner space of the main body 10 and the helical shape of the air guiding plate 11, develops a whirling movement. In the whirling movement of the air, particles drift away from the central axis according to masses and charges thereof, so that a correlation between sizes of particles and distances thereof from the central axis results. Adjusting the aperture 313 of the adjustable opening 30 allows to block particles beyond a certain distance from the central axis from being collected. Additional varying of the gap between the adjustable opening 30 and the precipitating device 40 optimizes controlling of the sizes of collected particles. The bias high voltage applied to the precipitating device 40 results in particles to be adsorbed on the cap 41. The precipitating device 40 is of cylinder shape, having an axial wire connected to high voltage, for adsorbing of particles.

Furthermore, as shown in FIG. 2, although the present invention utilizes electrostatic fields only, a sufficient flow of air is generated to collect particles effectively. The fan 50 on the entrance 12 or the exit 13 affects collected size distribution, controlling flow rate and speed of air for achieving precipitation of particles as envisaged.

The present invention offers the following advantages:

1. Low cost and easy maintenance due to electrostatic precipitation.
2. Low noise, low power consumption.
3. Effective collecting of particles according to sizes thereof by a whirling flow movement.
4. Easy control of particle collection by adjusting an aperture.
5. Variable position of fan, according to space available.

Referring to FIG. 6, in a second embodiment of the present invention, the main body 10 has an inner space that is of cylinder shape, simplifying the structure, with an air guiding plate 11*a* of helical shape laid out close to the periphery of the inner space.

Referring to FIG. 7, in a third embodiment of the present invention, an air guiding plate 11*b* is laid out close to the periphery of the inner space of the main body 10, air guiding plate 11*b* comprising less than a full twist of a helix. Thereby, cost of production is kept low and cleaning is facilitated.

Referring to FIG. 8, in a fourth embodiment of the present invention, a grid 23 covers the entrance 12, enhancing ionization of particles.

While the invention has been described with reference to preferred embodiments thereof, it is to be understood that modifications or variations may be easily made without departing from the spirit of this invention which is defined by the appended claims.

Figure 1:
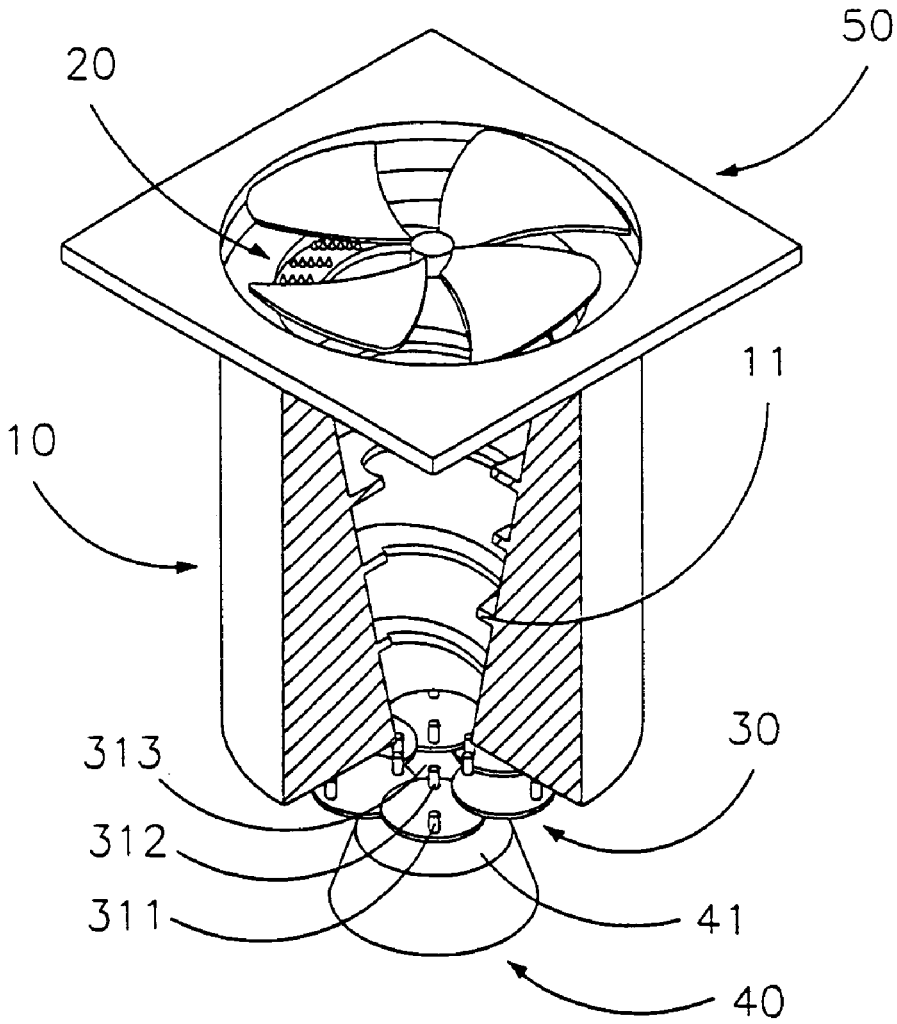
FIG. 1 is a perspective schematic view of the adjustable eddy electrostatic precipitator of the present invention.
Figure 2:
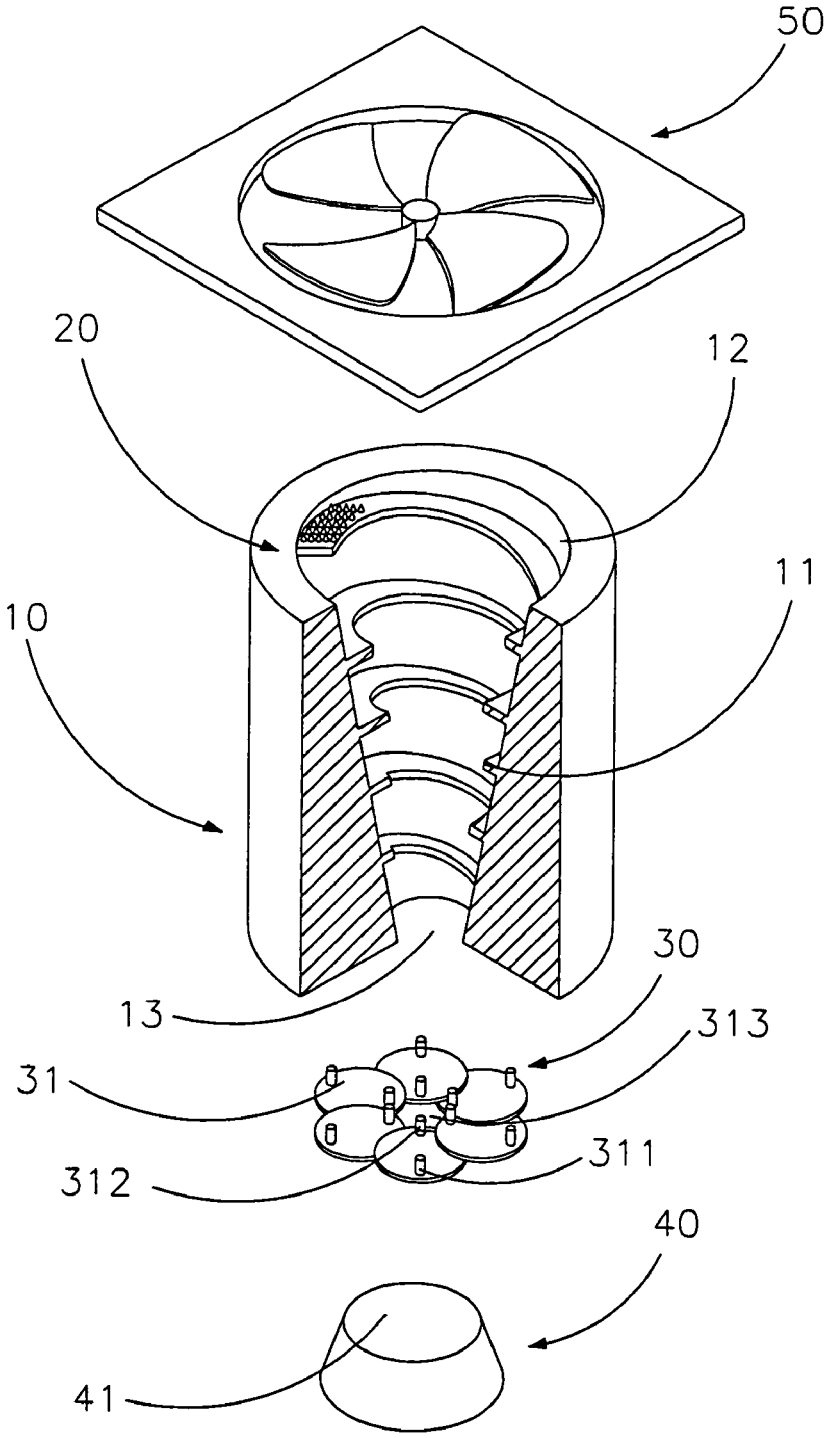
FIG. 2 is a perspective schematic view of the adjustable eddy electrostatic precipitator of the present invention when disassembled.
Figure 3:
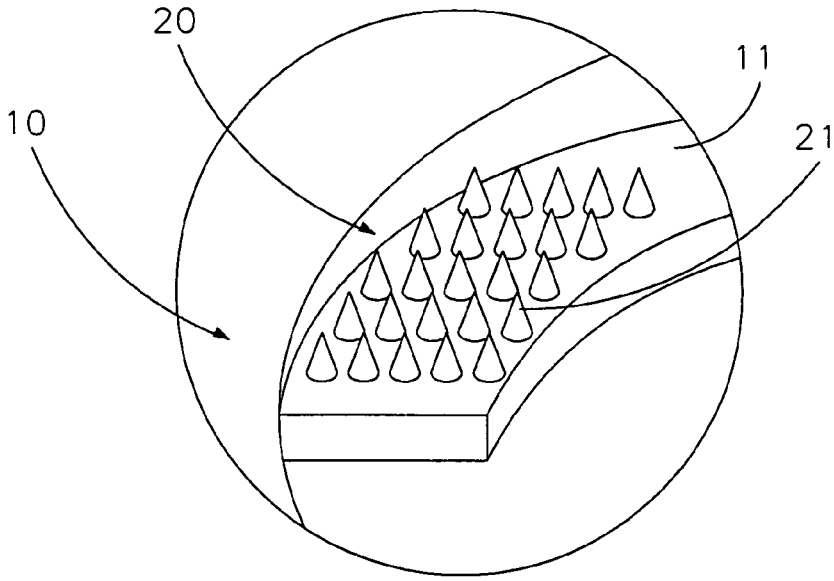
FIG. 3 is a schematic illustration of the electrostatic array of the present invention in an embodiment comprising single conical electrodes.
Figure 4:
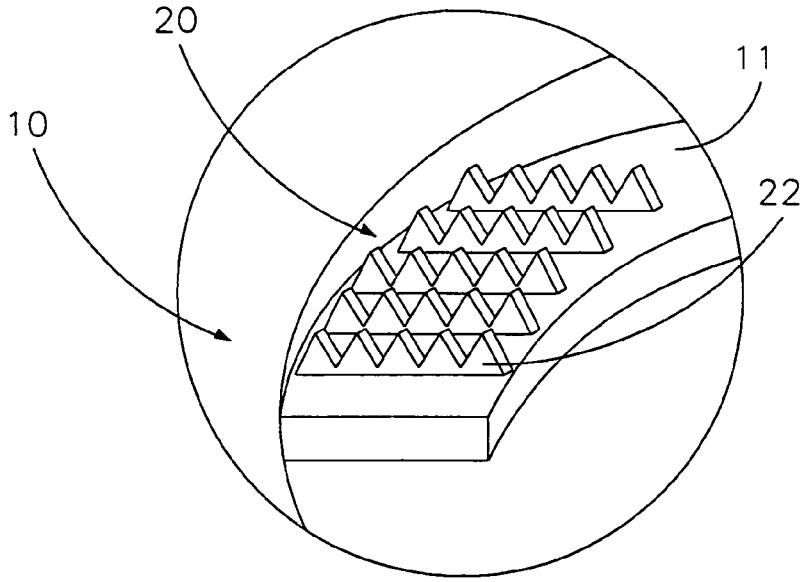
FIG. 4 is a schematic illustration of the electrostatic array of the present invention in an embodiment comprising rack-shaped electrodes.
Figure 5:
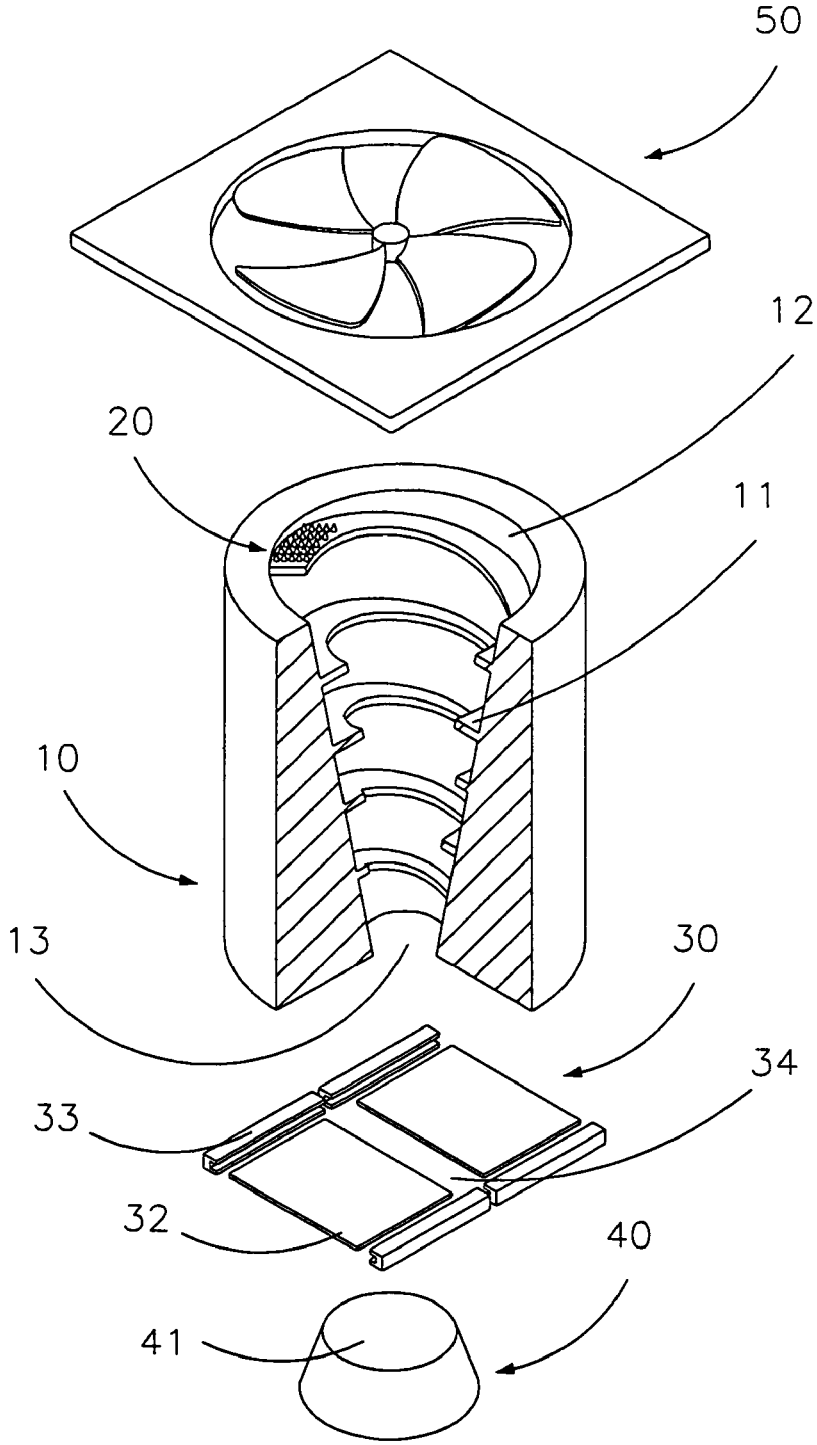
FIG. 5 is a perspective schematic view of the adjustable eddy electrostatic precipitator of the present invention when disassembled, having a slit aperture.
Figure 6:
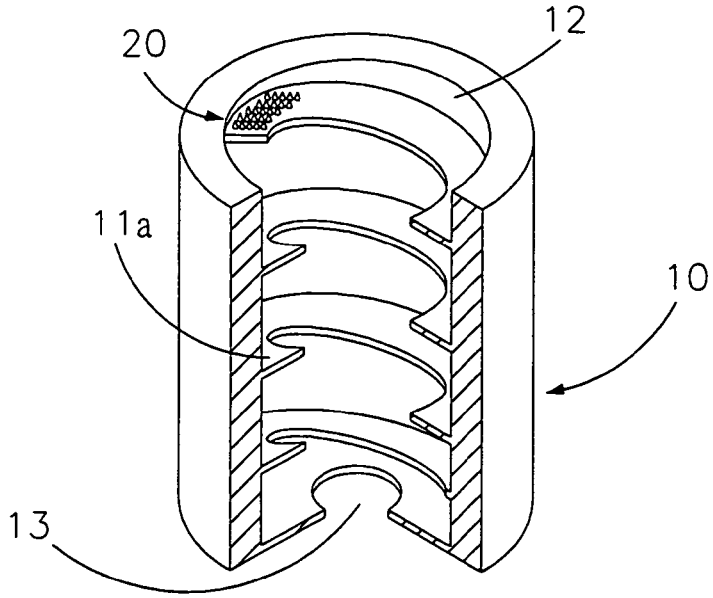
FIG. 6 is a perspective schematic view of the main body of the present invention in the second embodiment.
Figure 7:
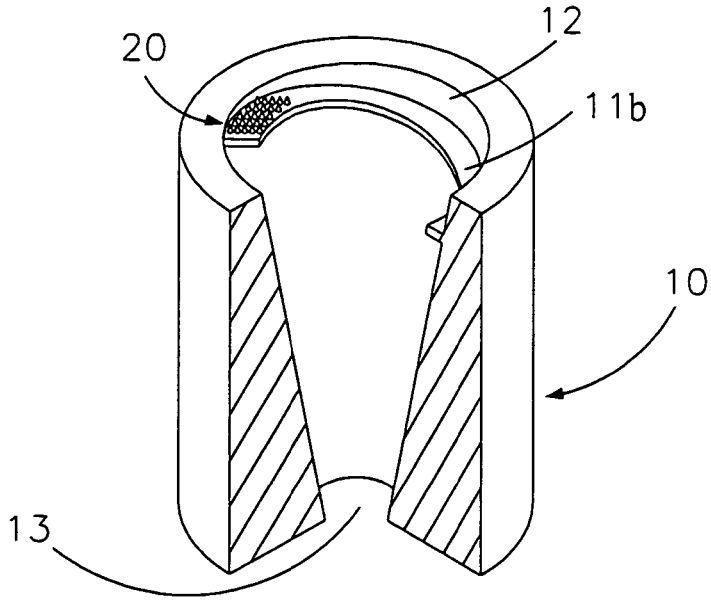
FIG. 7 is a perspective schematic view of the main body of the present invention in the third embodiment.
Figure 8:
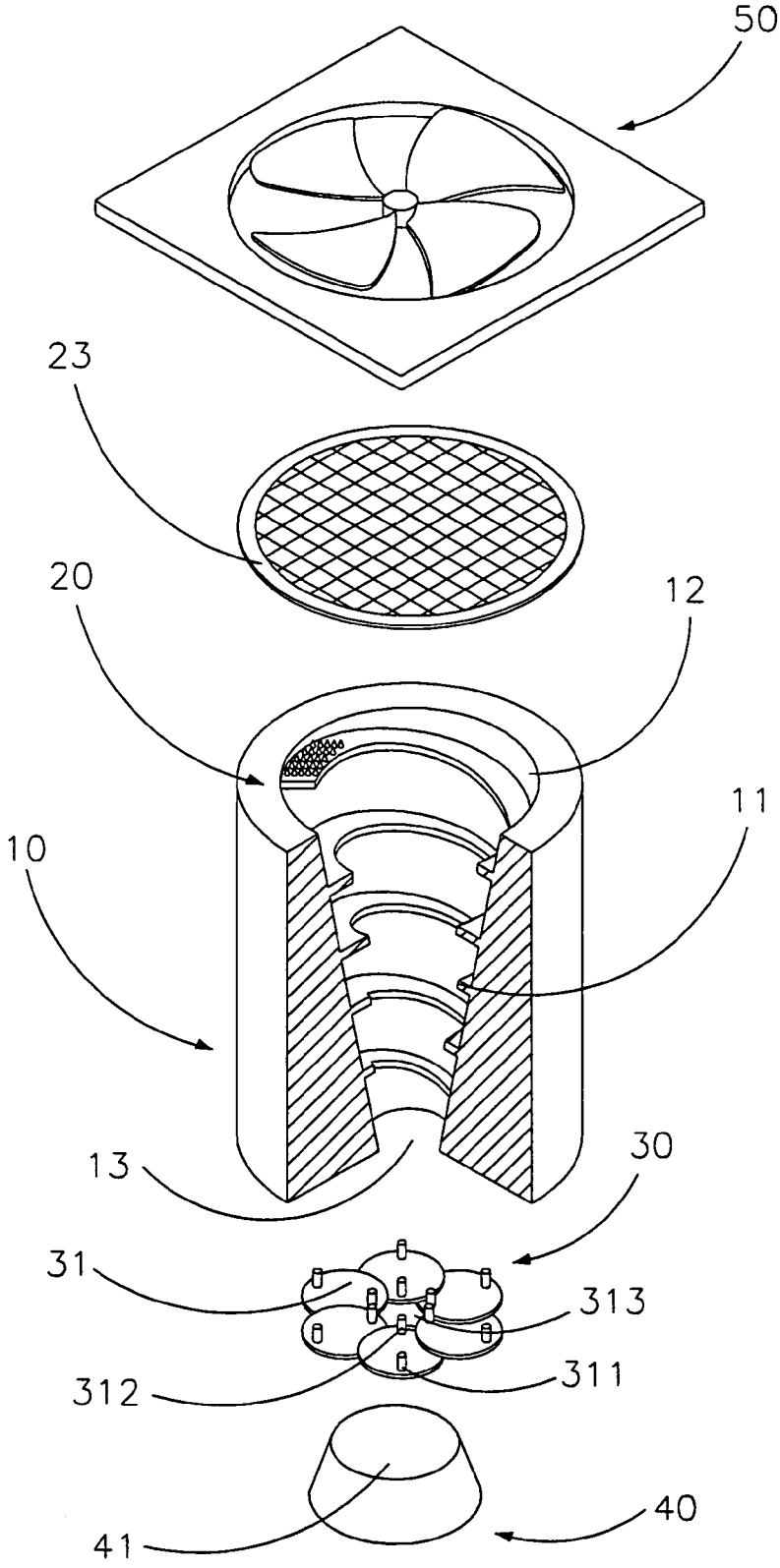
FIG. 8 is a perspective schematic view of the adjustable eddy electrostatic precipitator of the present invention in the fourth embodiment when disassembled.

What is claimed is:

1. An adjustable eddy electrostatic precipitator, comprising:

a main body, having an inner space with an air guiding plate of helical shape, an entrance for air and an exit for air;

an electrode array close to said entrance, ionizing particles floating in air;

an adjustable opening at said exit, having an adjustable aperture; and a precipitating device, connected with a bias high voltage, for adsorbing ionized particles.

2. The adjustable eddy electrostatic precipitator according to claim 1, wherein a fan is mounted at said entrance or said exit.

3. The adjustable eddy electrostatic precipitator according to claim 1, wherein said inner space of said main body is of truncated cone shape, with said air guiding plate of helical shape with decreasing diameter.

4. The adjustable eddy electrostatic precipitator according to claim 1, wherein said inner space of said main body is of cylinder shape, with said air guiding plate of helical shape with constant diameter.

5. The adjustable eddy electrostatic precipitator according to claim 1, wherein said adjustable opening is an iris diaphragm with an adjustable aperture.

6. The adjustable eddy electrostatic precipitator according to claim 1, wherein said adjustable opening is a slit opening with an adjustable width.

7. The adjustable eddy electrostatic precipitator according to claim 6, wherein said adjustable opening has opaque plates gliding between a pair of rails.

8. The adjustable eddy electrostatic precipitator according to claim 1, wherein said electrode array has a plurality of pointed electrodes.

9. The adjustable eddy electrostatic precipitator according to claim 1, wherein said electrode array has a plurality of rack-shaped linear electrodes.

10. The adjustable eddy electrostatic precipitator according to claim 1, wherein said electrode array has a grid.

11. The adjustable eddy electrostatic precipitator according to claim 1, wherein said precipitating device has a flat surface facing said main body.

12. The adjustable eddy electrostatic precipitator according to claim 1, wherein said precipitating device is of an obtuse cone shape.

13. The adjustable eddy electrostatic precipitator according to claim 1, wherein said precipitating device is of cylinder shape.

14. The adjustable eddy electrostatic precipitator according to claim 5, wherein said adjustable opening has a plurality of circular plates.

15. The adjustable eddy electrostatic precipitator according to claim 14, wherein each of said circular plates has a fixed bolt at a fixed position on said main body and a movable bolt revolving around said fixed bolt for varying said adjustable aperture.

16. The adjustable eddy electrostatic precipitator according to claim 13, wherein said precipitating device has an axial wire connected with high voltage.

17. The adjustable eddy electrostatic precipitator according to claim 1, wherein said air guiding plate covers at least one full twist.

18. The adjustable eddy electrostatic precipitator according to claim 8, wherein said pointed electrodes of said electrode array are set on a section of said air guiding plate close to said entrance.

19. The adjustable eddy electrostatic precipitator according to claim 9, wherein said rack-shaped electrodes of said electrode array are set on a section of said air guiding plate close to said entrance.

* * * * *

UNITED STATES PATENT AND TRADEMARK OFFICE

CERTIFICATE OF CORRECTION

PATENT NO. : 6,962,620 B2
APPLICATION NO. : 10/693737
DATED : November 8, 2005
INVENTOR(S) : Kai-Cheng Chang et al.

It is certified that error appears in the above-identified patent and that said Letters Patent is hereby corrected as shown below:

Title page,
Item [75], Inventors, "Pin-Cha Hsu," should read -- Pin-Chao Hsu, --.

Signed and Sealed this

Twentieth Day of June, 2006

JON W. DUDAS
*Director of the United States Patent and Trademark Office*